US005568127A

United States Patent [19]

Bang

[11] Patent Number: 5,568,127

[45] Date of Patent: Oct. 22, 1996

[54] DROWSINESS WARNING DEVICE AND NECK SUPPORT

[75] Inventor: Harry H. J. Bang, Pacific Palisades, Calif.

[73] Assignee: Richard M. Bang

[21] Appl. No.: 549,281

[22] Filed: Oct. 27, 1995

[51] Int. Cl.[6] ..... G08B 21/00

[52] U.S. Cl. ..... 340/575; 116/1; 116/28 R; 116/67 R; 116/137 R; 340/576; 340/691

[58] Field of Search ..... 340/575, 576, 340/691; 116/137 R, 67 R, 28 R, 1

[56] References Cited

U.S. PATENT DOCUMENTS

| | | | |
|---|---|---|---|
| 2,066,092 | 12/1936 | Brown | 116/67 R |
| 2,842,628 | 7/1958 | James | 340/575 |
| 3,340,846 | 9/1967 | Magiera | 116/67 R |
| 5,488,354 | 1/1996 | Colvin | 340/575 |

*Primary Examiner*—Glen Swann
*Attorney, Agent, or Firm*—Kelly, Bauersfeld & Lowry

[57] ABSTRACT

A drowsiness warning device includes a band which is securable about a wearer's neck, and an alarm positioned by the band below the wearer's chin for producing a tactile and an aural warning as the chin contacts the alarm device. The band includes a central section formed with a vertically stiff plastic material which is capable of holding a lower elongated body of the alarm therein. An upper rounded dome section of the alarm extends above the central section. The band also includes a pair of straps having hook and loop tape fasteners, and intermediate sections between the straps and the central section lined with a fibrous material for wearer comfort. In one embodiment, the alarm includes a hollow elastomeric ball having a mechanical noisemaker disposed within an air inlet/outlet aperture for the ball. In another embodiment, the alarm includes an electrically actuated speaker connectable to a battery on depression of the upper rounded dome.

19 Claims, 2 Drawing Sheets

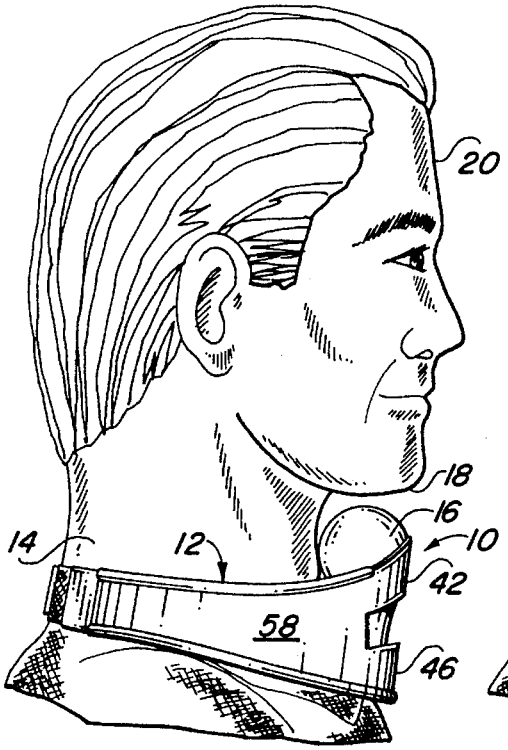
FIG. 1
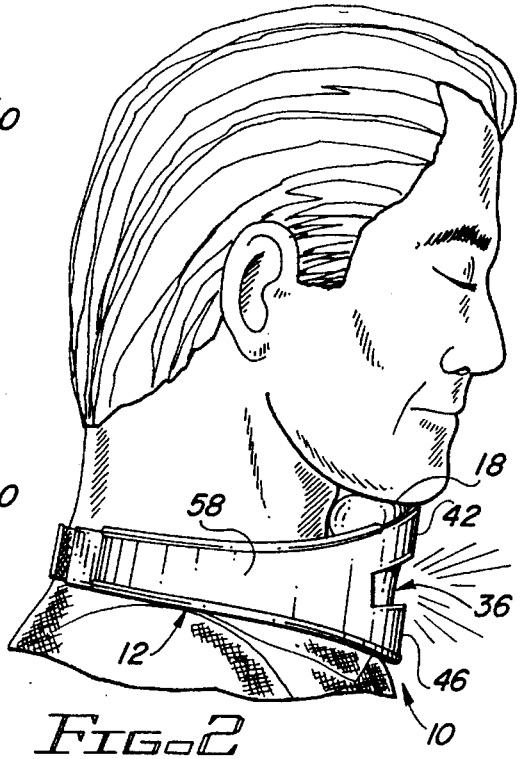
FIG. 2
FIG. 4
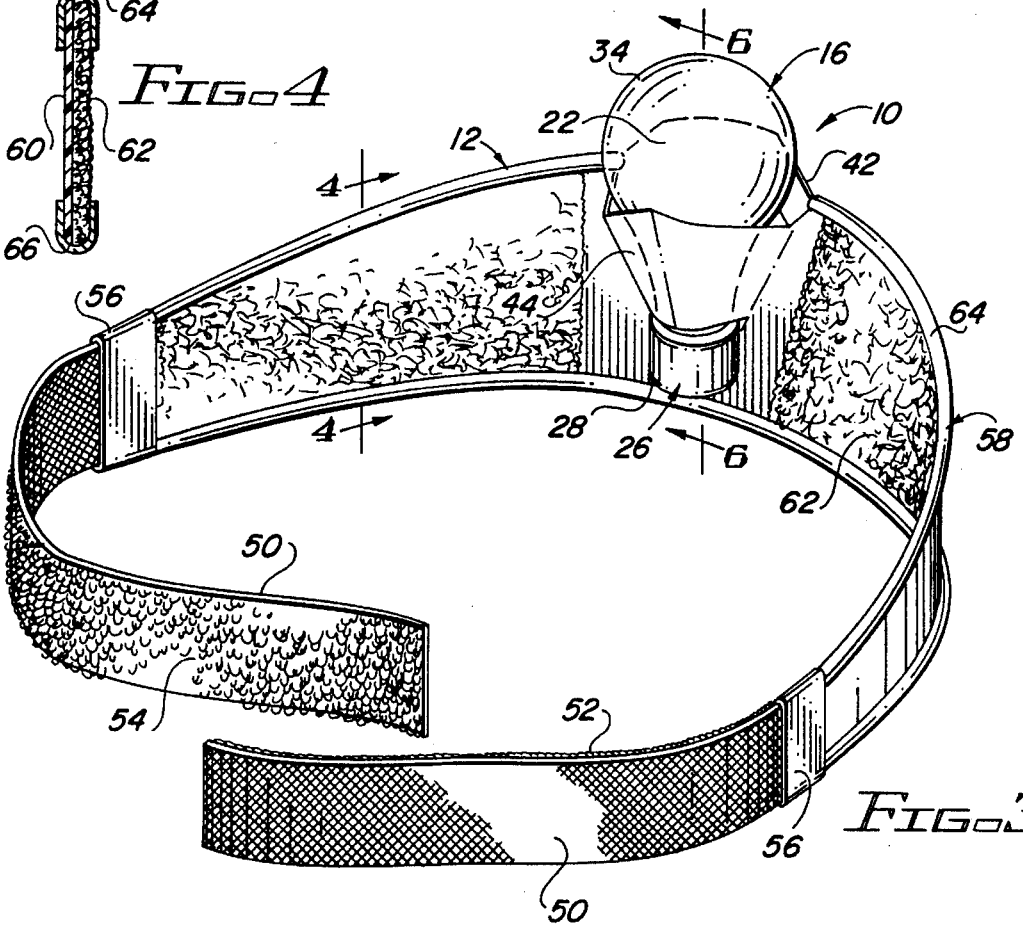
FIG. 3

DROWSINESS WARNING DEVICE AND NECK SUPPORT

BACKGROUND OF THE INVENTION

This invention relates generally to neck supports and devices intended to keep a wearer from falling asleep. More specifically, the present invention relates to a drowsiness warning device and neck support which provides a tactile and aural warning to a wearer as he or she becomes drowsy and the chin comes into contact with the device.

It is well known that many traffic accidents are caused by driver drowsiness and inattention to the road which occurs most frequently during long distance drives. The seriousness of the problems is emphasized by the number of people who lose their lives in such traffic accidents and the amount of property damage caused.

To prevent oneself from falling asleep at the wheel, many drivers take stimulants to help them stay awake. The problem is particularly acute in the case of truck and bus drivers who routinely drive long distances.

Accordingly, there has been a need for some type of device capable of alerting a driver that he or she is becoming drowsy at the wheel. In this regard it is known that the human chin droops naturally when one begins to feel sleepy or drowsy. A device, then, is needed which may be worn by a driver and provide an alarm when the driver's chin droops. Such a device must be comfortable to wear and, preferably, provide both tactile and aural warning. Further, such a device is needed which can provide some support to the neck in the case of an accident. The present invention fulfills these needs and provides other related advantages.

SUMMARY OF THE INVENTION

The present invention resides in a drowsiness warning device and neck support which is comfortable to wear, inexpensive to manufacture, and which satisfies all of the foregoing needs. The drowsiness warning device comprises, generally, a band securable about a wearer's neck, and alarm means positioned by the band below a wearer's chin for producing a tactile and an aural warning as the chin contacts the alarm means. The alarm means includes an upper rounded dome extending above an upper edge of the band immediately below the chin, a lower elongated body secured within the band and sound generation means activated by depressing the upper rounded dome with the chin.

In one preferred form of the invention, the band includes a central section which provides means for holding the lower body of the alarm means, a pair of straps including hook and loop tape fasteners and which define opposite ends of the band, and intermediate sections between the straps and the central section. The intermediate sections comprise a vertically stiff, exteriorly facing support member, a fibrous interiorly facing lining adjacent to the support member, and upper and lower edge guards extending over, respectively, upper and lower edges of the support member and the adjacent lining. The straps are connectable to one another for securing the band about the wearer's neck.

The central support comprises a vertical wall having a pair of parallel, generally horizontally extending slots cut therein to define an upper front support segment, an intermediate rear support segment and a lower front support segment between which the lower body of the alarm means is positioned. The vertical wall further includes a lower support tab which engages a bottom end of the lower body of the alarm means to limit downward movement thereof relative to the vertical wall.

The sound generation means comprises a hollow elastomeric ball, a portion of which forms the upper rounded dome, and a mechanical noisemaker disposed at least in part in a lower end of the ball. The mechanical noisemaker comprises an air actuated flute means positioned adjacent to an air inlet/outlet aperture for the elastomeric ball.

In another preferred form, the sound generation means comprises an electrically actuated speaker which is connectable to a battery on depression of the upper rounded dome. The upper dome includes a pair of upper contact plates, and the lower body includes a facing pair of lower contact plates. The alarm means includes spring means for urging the upper dome away from the lower body to space the upper plates from the lower plates in the absence of a counter-spring force applied by the chin to depress the upper dome and bring the upper and lower plates into contact to close the circuit between the speaker and the battery. Further, the sound generation means includes a printed circuit board for controlling the audio signal to the speaker.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is an elevational view illustrating the manner in which a drowsiness warning device embodying the invention is worn about a wearer's neck so as to position an upper elastomeric dome immediately below the wearer's chin;

FIG. 2 is a view similar to FIG. 1, illustrating the manner in which the chin engages the dome which, in turn, produces a tactile and an aural warning intended to alert the wearer of his or her drowsy condition;

FIG. 3 is an enlarged perspective view of the drowsiness warning device shown in FIGS. 1 and 2;

FIG. 4 is an enlarged sectional view taken generally along the line 4—4 of FIG. 3, illustrating the specific construction of an intermediate section of a neck band of the drowsiness warning device;

DETAILED DESCRIPTION OF THE PREFERRED EMBODIMENT

Figures 5, 6, 7, 8:
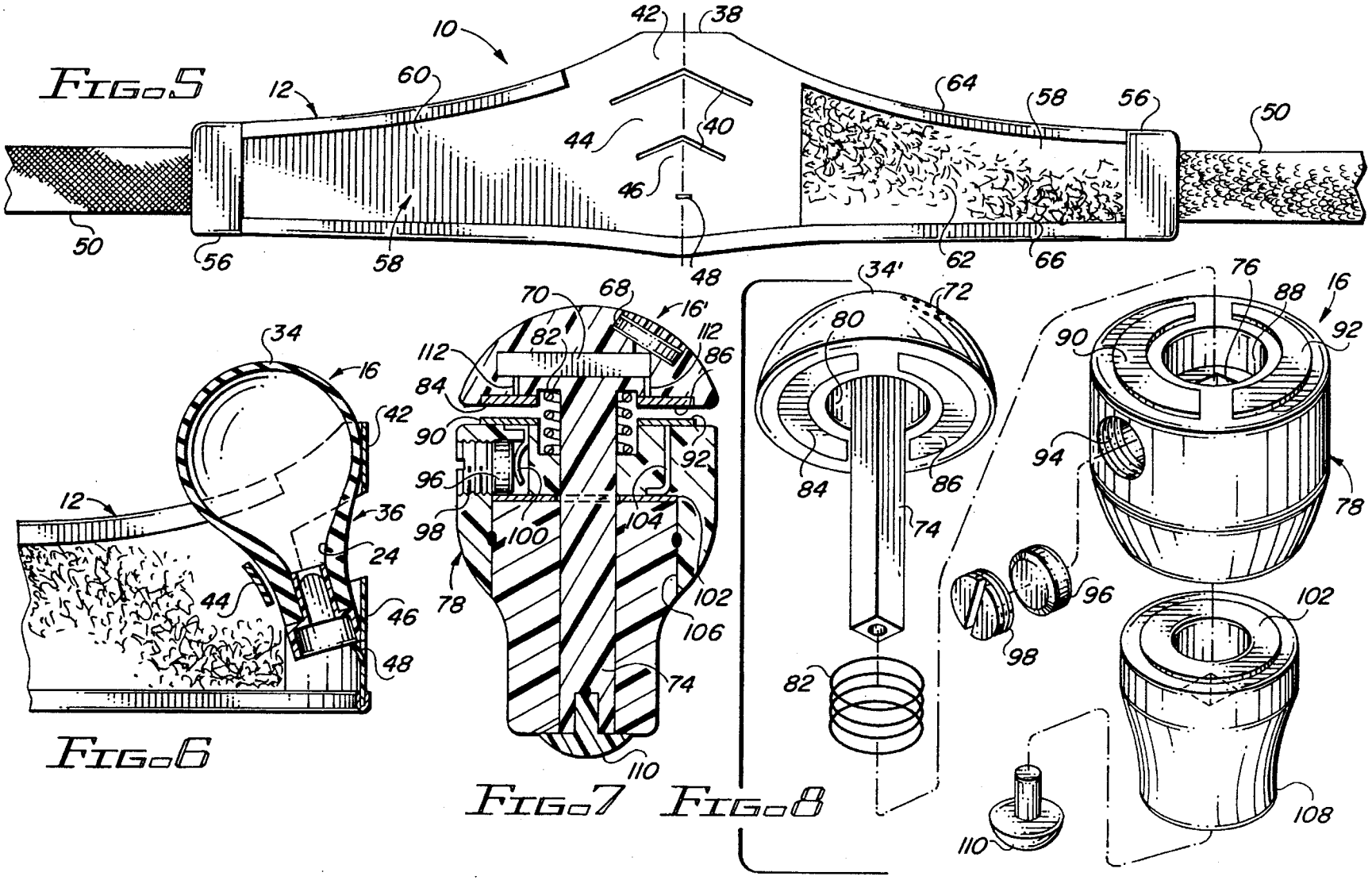
FIG. 5 is a fragmented elevational view of the neck band of FIG. 3, illustrating, to the left of a center line, the outside surface of the neck band, and, to the right of the center line, an inside surface.
FIG. 6 is an enlarged, fragmented and partially sectional view taken generally along the line 6—6 of FIG. 3, illustrating one embodiment of an alarm device supported within a central section of the neck band.
FIG. 7 is an enlarged sectional view illustrating the components of an alternative form of the alarm device including an electrically actuated speaker.
FIG. 8 is an exploded perspective view of the alarm device illustrated in FIG. 7.

As shown in the drawings for purposes of illustration, the present invention is concerned with a drowsiness warning device and neck support, generally designated in the accompanying drawings by the reference number 10. The drowsiness warning device 10 comprises, generally, a neck band 12 which is securable about a wearer's neck 14, and an alarm device 16 which is positioned by the band below the wearer's chin 18. The alarm device is capable of producing both a tactile and an aural warning as the chin 18 contacts the alarm device 16 when the wearer's head 20 droops. (See FIGS. 1 and 2).

In accordance with the present invention, and as illustrated with respect to a first embodiment in FIGS. 3–6, the alarm device 16 comprises a hollow elastomeric ball 22 and a mechanical noisemaker disposed adjacent to an air inlet/outlet aperture 24 for the ball. The mechanical noisemaker comprises a bugle-shaped pipe 26 having a first portion 28 that extends into the air inlet/outlet aperture 24, and a second enlarged portion 30 which extends downwardly from the aperture 24. An air flute 32 is disposed within the first portion 28 of the bugle-shaped pipe 26 for producing an aural warning as air passes through the aperture 24. In this regard, the hollow ball 22 includes an upper rounded dome 34 which extends above an upper edge of the neck band 12 and which is positioned immediately below the chin 18. Extending downwardly from the dome 34 is an elongated lower body 36 which is securely held within a central section 38 of the neck band 12.

The central section 38 of the neck band 12 comprises a vertical wall having a pair of parallel, generally horizontally extending slots 40 which are cut therein to define an upper front support segment 42, an intermediate rear support segment 44 and a lower front support segment 46 between which the lower body 36 of the alarm device 16 is positioned. Further, a lower support tab 48 is disposed below the slots 40 to engage a bottom end of the lower body 36 of the alarm device 16, to limit downward movement thereof relative to the vertical wall of the central section 38. A shown, the lower support tab 48 engages the bottom end of the bugle-shaped pipe 26.

A pair of straps 50 define opposite ends of the neck band 12. The straps include hook tape 52 and loop tape 54 fasteners which engage each other in a known manner to secure the straps 50 to one another. The straps 50 are connected, utilizing strap anchors 56, to intermediate sections 58 of the neck band 12 which extend between the central section 38 and the straps 50. The intermediate sections 58 include a vertically stiff, exteriorly facing support member 60, a fibrous interiorly facing lining 62 adjacent to the support member 60, and upper and lower edge guards 64 and 66 extending over, respectively, upper and lower edges of the support member 60 and adjacent lining 62 (see FIG. 4).

As noted above, the drowsiness warning device 10 is constructed to position the dome 34 of the alarm device 16 immediately below the chin 18 of the wearer. As the wearer becomes drowsy, the head 20 naturally droops thus causing the chin 18 to engage the dome 34. Such engagement provides a tactile warning that the person is becoming drowsy. Upon depression of the dome 34, air is forced from the hollow ball 22 through the air inlet/outlet aperture 24. Such air movement causes the air flute 32 to issue an aural warning to the wearer that he or she is falling asleep.

FIGS. 7 and 8 illustrate an alternative embodiment of the alarm device 16' which utilizes an electrically actuated speaker 68 disposed within the dome 34'. In this embodiment, the upper rounded dome 34' has embedded therein the speaker 68 and a printed circuit board 70 which controls the audio signal to the speaker. A plurality of speaker apertures 72 are provided through the dome 34 adjacent to the speaker 68. Extending downwardly from the upper dome 34' is a square shaft 74 that extends through a square through-hole 76 provided in a main body 78 of the alarm device 16'. Surrounding an upper end of the square shaft 74 is an upper spring well 80 into which an upper end of a spring 82 extends. A lower surface of the dome 34' supports a pair of upper contact plates 84 and 86, the function of which will be explained below.

The main body 78 includes a lower spring well 88 in which a lower portion of the spring 82 is situated. An upper surface of the main body 78 supports a pair of lower contact plates 90 and 92 disposed opposite the upper contact plates 84 and 86. A battery chamber 94 is provided in the main body 78 into which a battery 96 is inserted and enclosed therein by a battery access screw 98. A first conductive lead connector 100 extends from the first lower contact plate 90 to an end of the battery 96. A conductive contact ring 102 extends from a side of the battery 96 to a second conductive lead connector 104 which extends to the second lower contact plate 92. The contact ring 102 is placed within a recess 106 within the main body 78 and held in place by an insert 108. The lower end of the square shaft 74 extends to a lower end of the insert 108, and an end plug 110 is fastened to a lower end of the square shaft 74 to prevent it from being withdrawn from the main body 78. The end plug 110 is secured to the square shaft 74, and the insert 108 is secured to the main body 78 within the recess 106, by means of an ultrasonic weld or the like.

A pair of conductive leads 112 extend between respective ones of the upper contact plates 84 and 86 and the printed circuit board 70. This arrangement causes an aural warning to issue from the speaker 68 when the electrical circuit is completed by bringing the upper contact plates 84 and 86 into contact with the lower contact plates 90 and 92. The spring 82, however, normally biases the dome portion 34' away from the main body 78, thereby opening the circuit and preventing operation of the speaker 68 in the absence of a depressing force supplied to the dome portion 34' by the chin 18 of the wearer of the drowsiness warning device 10.

From the foregoing it is to be appreciated that the drowsiness warning device 10 provides a novel apparatus for alerting a wearer when his or her head 20 begins to droop due to drowsiness. In addition to drivers, the device 10 may be advantageously utilized by others who are subject to becoming drowsy, such as night watchmen. The device 10 is manufactured of relatively simple components and is quite easy to use. Besides issuing an aural warning, contact between the chin 18 and the upper dome 34 provides tactile indicia that the wearer is becoming drowsy. Moreover, the provision of the fibrous lining 62 in the neck band 12 provides for a separation between the neck 14 and the plastic support member 60 which prevents sweating and ensures that the neck band 12 will remain comfortable to the wearer. The provision of hook and loop tape fasteners 52 and 54 ensures that the neck band 12 is adjustable for different neck sizes.

Although two particular embodiments of the invention have been described in detail for purposes of illustration, various modifications of each may be made without departing from the spirit and scope of the invention. Accordingly, the invention is not to be limited, except as by the appended claims.

I claim:

1. A drowsiness warning device, comprising:

a band securable about a wearer's neck; and alarm means positioned by the band below a wearer's chin, for producing an aural warning as the chin contacts the alarm means, wherein the alarm means includes an upper rounded dome extending above an upper edge of the band and positioned immediately below the chin, and a lower elongated body secured within the band.

2. The drowsiness warning device of claim 1, wherein the alarm means includes sound generation means therein activated by depressing the upper rounded dome with the chin.

3. The drowsiness warning device of claim 2, wherein the sound generation means comprises a hollow elastomeric ball, a portion of which forms the upper rounded dome, and a mechanical noisemaker disposed at least in part in a lower end of the ball.

4. The drowsiness warning device of claim 3, wherein the mechanical noisemaker comprises an air actuated flute means positioned adjacent to an air inlet/outlet aperture for the elastomeric ball.

5. The drowsiness warning device of claim 2, wherein the sound generation means comprises an electrically actuated speaker connectable to a battery on depression of the upper rounded dome.

6. The drowsiness warning device of claim 5, wherein the sound generation means includes a printed circuit board for controlling an audio signal to the speaker.

7. The drowsiness warning device of claim 5, wherein the upper dome includes a pair of upper contact plates, and the lower body includes a facing pair of lower contact plates, and wherein the alarm means includes spring means for urging the upper dome away from the lower body to space said upper plates from said lower plates in the absence of a counter-spring force applied by the chin to depress the upper dome and bring the upper and lower plates into contact.

8. The drowsiness warning device of claim 1, wherein the band includes central means for holding the lower body of the alarm means, and strap means at ends of the band and connectable to one another for securing the band about the wearer's neck.

9. The drowsiness warning device of claim 8, wherein the strap means includes hook and loop tape fasteners.

10. The drowsiness warning device of claim 8, wherein the band means includes intermediate sections between the strap means and the central holding means, comprising a vertically stiff exteriorly facing support member, a fibrous interiorly facing lining adjacent to the support member, and upper and lower edge guards extending over, respectively, upper and lower edges of the support member and the adjacent lining.

11. The drowsiness warning device of claim 8, wherein the central holding means comprises a vertical wall having a pair of parallel, generally horizontally extending slots cut therein to define an upper front support segment, an intermediate rear support segment and a lower front support segment of the wall between which the lower elongated body of the alarm means is positioned.

12. The drowsiness warning device of claim 11, wherein the vertical wall further includes a lower support tab which engages a bottom end of the lower body of the alarm means to limit downward movement thereof relative to the vertical wall.

13. A drowsiness warning device, comprising:

a band including a central section, strap means at opposite ends of the band and connectable to one another for securing the band about a wearer's neck, and intermediate sections between the strap means and the central section; and alarm means positioned by the central section of the band below a wearer's chin, for producing an aural warning as the chin contacts the alarm means, the alarm means including an upper rounded dome extending above an upper edge of the central section of the band and positioned immediately below the chin, a lower elongated body secured within the central section of the band, and sound generation means actuated by depressing the upper rounded dome with the chin.

14. The drowsiness warning device of claim 13, wherein the central section comprises a vertical wall having a pair of parallel, generally horizontally extending slots cut therein to define an upper front support segment, an intermediate rear support segment and a lower front support segment between which the lower elongated body of the alarm means is positioned, and a lower support tab which engages a bottom end of the lower body of the alarm means to limit downward movement thereof relative to the vertical wall.

15. The drowsiness warning device of claim 14, wherein the strap means includes hook and loop tape fasteners, and wherein the intermediate sections comprise a vertically stiff, exteriorly facing support member, a fibrous interiorly facing lining adjacent to the support member, and upper and lower edge guards extending over, respectively, upper and lower edges of the support member and the adjacent lining.

16. The drowsiness warning device of claim 13, wherein the sound generation means comprises a hollow elastomeric ball, a portion of which forms the upper rounded dome, and a mechanical noisemaker disposed at least in part in a lower end of the ball, the noisemaker comprising an air actuated flute means positioned adjacent to an air inlet/outlet aperture for the elastomeric ball.

17. The drowsiness warning device of claim 13, wherein the sound generation means comprises an electrically actuated speaker connectable to a battery on depression of the upper rounded dome, wherein the upper dome includes a pair of upper contact plates and the lower body includes a facing pair of lower contact plates, and wherein the alarm means includes spring means for urging the upper dome away from the lower body to space said upper plates from said lower plates in the absence of a counter-spring force applied by the chin to depress the upper dome and bring the upper and lower plates into contact.

18. A drowsiness warning device, comprising:

a band including a central section, strap means at opposite ends of the band and connectable to one another for securing the band about a wearer's neck, and intermediate sections between the strap means and the central section;

alarm means positioned by the central section of the band below a wearer's chin, for producing an aural warning as the chin contacts the alarm means, the alarm means including an upper rounded dome extending above an upper edge of the central section of the band and positioned immediately below the chin, a lower elongated body secured within the central section of the band, and sound generation means actuated by depressing the upper rounded dome with the chin, wherein the sound generation means comprises a hollow elastomeric ball, a portion of which forms the upper rounded dome, and a mechanical noisemaker disposed at least in part in a lower end of the ball, the noisemaker comprising an air actuated flute means positioned adjacent to an air inlet/outlet aperture for the elastomeric ball;

wherein the central section comprises a vertical wall having a pair of parallel, generally horizontally extending slots cut therein to define an upper front support segment, and intermediate rear support segment and a lower front support segment between which the lower elongated body of the alarm means is positioned, and a lower support tab which engages a bottom end of the lower portion of the alarm means to limit downward movement thereof relative to the vertical wall.

19. The drowsiness warning device of claim 18, wherein the strap means includes hook and loop tape fasteners, and wherein the intermediate sections comprise a vertically stiff, exteriorly facing support member, a fibrous interiorly facing lining adjacent to the support member, and upper and lower edge guards extending over, respectively, upper and lower edges of the support member and the adjacent lining.

* * * * *